US005683235A

United States Patent [19]

Welch

[11] Patent Number: 5,683,235

[45] Date of Patent: Nov. 4, 1997

[54] HEAD PORT SEALING GASKET FOR A COMPRESSOR

[75] Inventor: John Patrick Welch, Olean, N.Y.

[73] Assignee: Dresser-Rand Company, Corning, N.Y.

[21] Appl. No.: 411,891

[22] Filed: Mar. 28, 1995

[51] Int. Cl.[6] ..... F04B 39/10

[52] U.S. Cl. ..... 417/572; 277/178; 277/285

[58] Field of Search ..... 417/572, 423.8; 277/178, 285

[56] References Cited

U.S. PATENT DOCUMENTS

| | | | |
|---|---|---|---|
| 2,477,533 | 7/1949 | Whiting | 277/178 |
| 3,202,463 | 8/1965 | Fatt | 277/178 |
| 3,290,047 | 12/1966 | Mayer | 277/2 |
| 3,528,666 | 9/1970 | Prampart . | |
| 4,384,724 | 5/1983 | Derman . | |
| 4,410,186 | 10/1983 | Pierce, Jr. . | |
| 4,844,124 | 7/1989 | Stich et al. . | |
| 5,073,146 | 12/1991 | Beck | 417/571 |
| 5,076,589 | 12/1991 | Marsi . | |

*Primary Examiner*—Timothy Thorpe
*Assistant Examiner*—Ted Kim
*Attorney, Agent, or Firm*—Sidley & Austin

[57] ABSTRACT

A head port sealing gasket (56) is disclosed for use in a barrel compressor (40) which has a head (42) fit within a barrel casing (44). The sealing gasket (56) has a curved outer surface (60) matching the curvature of the inner diameter of the barrel casing (44). An O-ring is fit within an O-ring groove (62) in the outer surface to sealingly engage the inner surface of the barrel casing. The sealing gasket (56) is received within a port (68) formed into the outer cylindrical surface of the head. A chamfer (92) on the end of the casing (44) allows the head and sealing gasket mounted thereon to be slid into the proper position within the barrel casing without damage to the O-ring.

18 Claims, 4 Drawing Sheets

HEAD PORT SEALING GASKET FOR A COMPRESSOR

TECHNICAL FIELD OF THE INVENTION

This invention relates to a compressor, and particularly to a sealing gasket for use in the compressor.

BACKGROUND OF THE INVENTION

This invention relates to compressors such as a barrel compressor. Barrel compressors are high power, high speed compressors, often installed in a train of compressors coupled end to end which are driven by dry couplings extending between them. The compressors include a barrel and heads which must be sealed within the confines of the barrel. Lines for lubrication, high pressure sealing gas and drainage have conventionally been directed through one or both of the heads through lines parallel to the center axis of the barrel. Thus, whenever the head is removed, each of the couplings for these lines must be removed as well. This has proven to be time consuming during service.

Further, the compressors provide little volume available for a coupling guard. Coupling windage induced is very high and coupling guard temperature is high which may lead to undesirable results. Further, it is often a requirement to have probes measure conditions within the compressor and it has been difficult to install such probes and disassemble them for maintenance.

In the case of vertically split compressors, the exterior cylindrical shell is unitary. Thus, the components of the compressor within must be removed through one or both ends of the cylindrical shell. In previous designs, a complexity of piping was led into the head of the compressor. Such piping includes lubrication oil supply to the bearings, lubrication oil exiting pipe and return, seal oil inlet piping, seal oil drain, thrust disc lubricant supply and drain, seal buffer gas supply and balanced drum return line. In these previous designs, the lines enter through the head and increase the complexity and expense involved when removing and re-installing the head for repair and maintenance.

A need exists for an improved design which will facilitate the use of such a compressor, realizing the requirements for increased access for various lines and sensors with a necessary coupling guard system.

SUMMARY OF THE INVENTION

In accordance with one aspect of the present invention, a barrel compressor is provided which includes a head having a cylindrical outer diameter and at least one passage formed through the head. A casing is provided which has a cylindrical inner diameter and a passage formed therethrough. The head is mounted within the casing with the cylindrical outer diameter of the head facing the cylindrical inner diameter of the casing and with the passages in alignment. A sealing gasket, having an outer surface curved to the curvature of the inner diameter of the casing, sealingly engages the inner diameter of the casing while a second surface of the sealing gasket sealingly engages the head. The sealing gasket has a passage therethrough connecting the passage in the head with the passage in the casing.

In accordance with another aspect of the present invention, the first sealing surface has an O-ring groove formed therein, the compressor further including an O-ring fitted within the O-ring groove. In accordance with another aspect of the present invention, the sealing gasket has a cylindrical surface forming the second surface, an O-ring groove formed therein, and an O-ring groove received in the O-ring.

BRIEF DESCRIPTION OF THE DRAWINGS

For a more complete understanding of the present invention and the advantages thereof reference is now made to the following description taken in conjunction with the accompanying drawings, in which.

DETAILED DESCRIPTION

Figure 1:
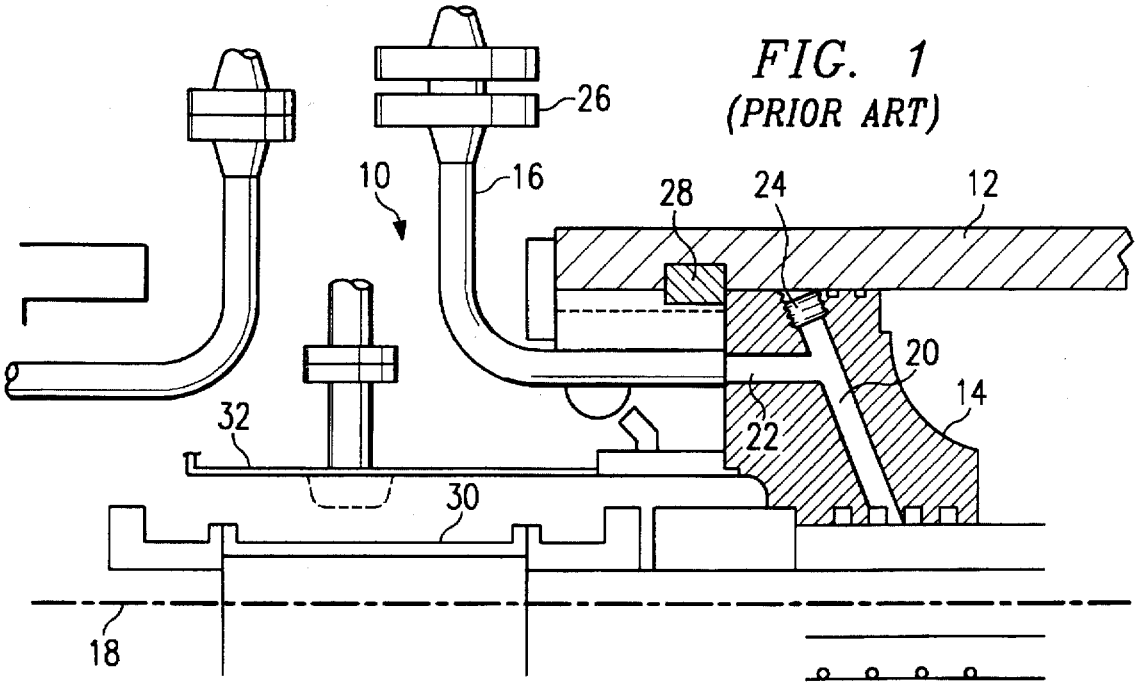
FIG. 1 (PRIOR ART)
FIG. 1 is a cross-sectional view of a conventional barrel compressor illustrating the present piping connections.

With reference to FIG. 1, a conventional barrel compressor 10 is illustrated. The compressor includes a barrel casing 12 and a head 14 which fits within the inner diameter of the barrel casing and is sealed thereto. Numerous lines 16 are mounted to the head at various positions around the center axis 18 of the compressor. Lines 16 include lines for gas seals, lubrication, vents and drains. As can be seen, each line requires a passage 20 and passage 22 to be bored through the head, with the outer end of passage 20 being threaded to receive a sealing plug 24. The line 16 is sealingly connected to the end of passage 22 and extends generally parallel the axis 18 beyond the end of the casing, where it turns outward to form a coupling 26. The head itself is held in position by a shear ring 28. A coupling 30 and coupling guard 32 are mounted to the piston within the compressor.

It can be understood that if the head 14 must be removed, all of the couplings 26 and lines 16 must be disconnected first in order to provide room for the head to slide out of the end of the casing along the center axis 18. This has proven inconvenient and time consuming in service. Further, the presence of the lines 16 prevent the coupling guard 32 from being any larger than is possible to avoid interfering with the lines. For high power, high speed compressors arranged in a train and driven by dry couplings, it is common for coupling windage to induce high coupling guard temperatures due to the little volume available for the coupling guard. This can provide a safety hazard as well as damage standard instrumentation such as wires, packing glands and the like. With compressors arranged in a string, there is little access to the bearings, seals and the coupling and this has lead to a design using many components, such as adapters spiked with radial instrument bosses, baffles or labyrinths and split coupling guards on each side of the compressor. Also, this has lead to special coupling spacers and two or three part spacers instead of a simple tube. This design often implies poor coupling balance or balance repeatability, requiring field balancing actions which are expensive. Presently there is no access to the radial vibration probes when the machine is running while pertinent codes require removable probes in service.

With reference now to FIGS. 2–9, a barrel compressor 40 is illustrated which incorporates a first embodiment of the present invention. The compressor 40 includes a head 42 and a barrel casing 44. The head has a series of passages 46 and radial passages 48 formed therein, with the radial passages 48 opening through the outer surface diameter 50 of the head facing the inner surface diameter 52 of the barrel casing. The radial passages 48 are aligned with radial passages 54 formed through the barrel casing and the passages are connected through a head port sealing gasket 56, best illustrated in FIGS. 5–7. A service pipe 58 is sealingly secured to the outer surface of the barrel casing 44 in fluid connection with the radial passage 54.

Figure 5:
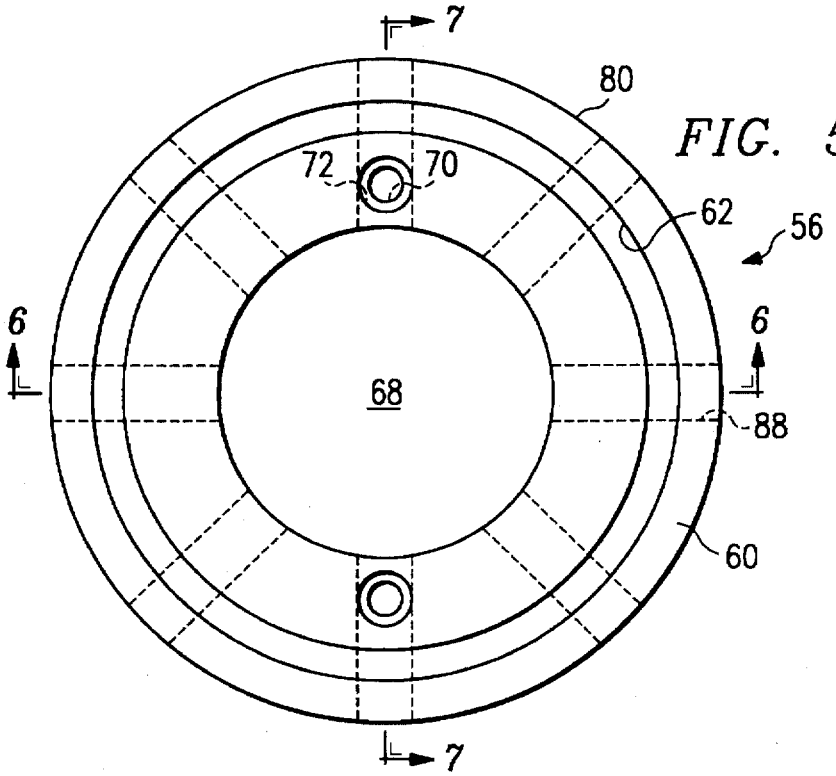
FIG. 5 is a plan view of the head port sealing gasket.
Figure 6:
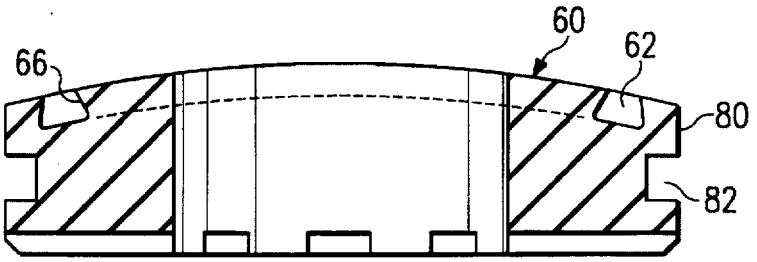
FIG. 6 is a section view of the gasket taken along line 6—6 in FIG. 5.
Figure 7:
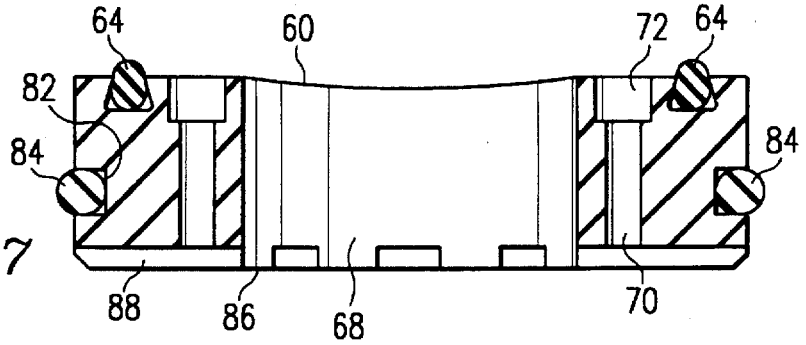
FIG. 7 is a section view of the gasket taken along line 7—7 in FIG. 5.

As best seen in FIGS. 5–7, the head port sealing gasket 56 has an outer surface 60 which is curved with a radius closely approximating the radius of curvature of the inner surface diameter 52 of the barrel casing 44. An O-ring groove 62 is formed in the outer surface to receive an O-ring 64 to seal against the inner diameter 52 of the barrel casing 44. The O-ring groove 62 is designed to capture the O-ring 64 within groove 62 with inwardly directed edges 66. This will insure the O-ring stays within the groove despite the curvature of the outer surface 60 yet can still sealingly compress against the inner diameter 52 of the barrel casing.

The gasket has a large port 68 therethrough that forms a continuation of the passages 48 and 54. Port 68 lies within the radial confines of the O-ring 64. A pair of holes 70 with counter bores 72 are drilled through the gasket to receive bolts to bolt the gasket into the head 42. As can best be seen in FIGS. 2 and 4, an aperture 74 is drilled through the outer diameter 50 of the head to receive the gasket 56 so that only a small portion of the gasket and O-ring 64 extend outward of the outer diameter 50 to sealingly engage the inner diameter 52 of the barrel casing 44. The aperture has an annular bottom surface 76 and a cylindrical side surface 78. The gasket 56 has a cylindrical side surface 80 with an O-ring groove 82 formed therein to receive an O-ring 84. The O-ring 84 seals between the cylindrical side surfaces 78 and 80 of the head and gasket. The inner surface 86 of the gasket 56 is formed with a series of radial passages 88 which open into the port 68 and extend to the side surface 80 to equalize pressure on seal 84. The sealing gaskets 56 can be made of polyetheretherketone (PEEK) such as arlon 1000 or other suitable materials.

Figure 8:
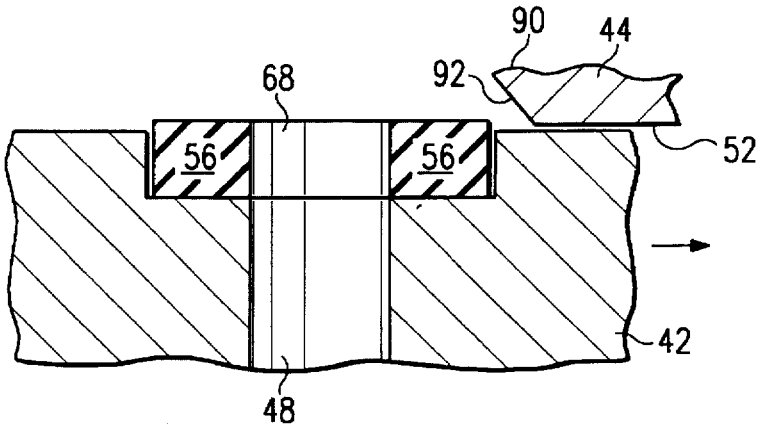
FIG. 8 is an illustration of the head being moved into position in the barrel casing.
Figure 9:
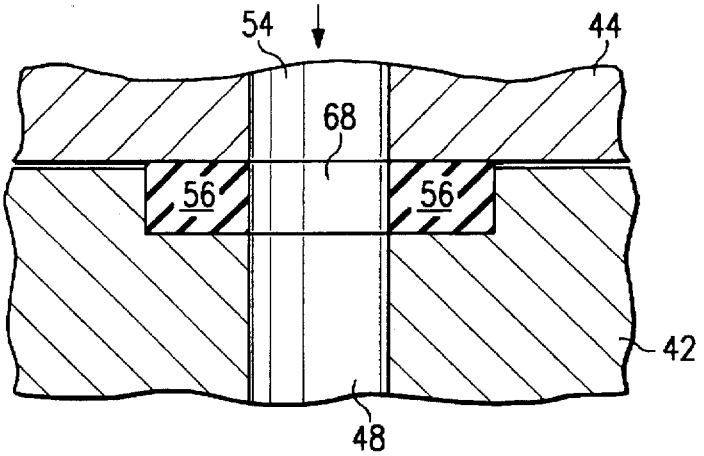
FIG. 9 is a view of the head installed in the barrel casing.

It can readily be understood that the gasket 56 provides a sealed connection between the passage 48 in the head and the passage 54 in the barrel casing 44. Furthermore, to disassemble the head from the casing, the shear ring 28 need only be removed and the head need merely be slid out of the end 90 of the casing along with the respective gaskets 56 mounted thereon, eliminating the need to disconnect piping such as lines 16 in the conventional design. When the head is to be installed in the barrel casing 44, the gaskets are simply bolted into their respective apertures 74 and the head is slid into the casing 44 at end 90. The end 90 of the barrel casing 44 can be seen to have a chamfer 92 that, as the head is slid into the end of the barrel casing, as seen in FIG. 8, will compress the O-ring 64, and not tear or cut the O=ring. The O-ring 64, when uncompressed, extends outward radially a distance greater than the inner diameter 52 of the barrel casing. Once the chamfer 92 compresses the O-ring sufficiently, the head need only be slid further into the barrel casing to its proper final position where the O-ring 64 will sealingly engage the barrel casing to seal the passage, as seen in FIG. 9. If the head 42 is not inserted in the proper angular relation with casing 44 about axis 18, the gaskets 56 allow the head to simply be rotated about axis 18 sufficiently to orient the head properly. As will be appreciated, there are typically two heads 42 mounted in each casing 44, near the ends thereof, and each head can mount such gaskets 56 as are desired for operation of the compressor.

Figure 2:
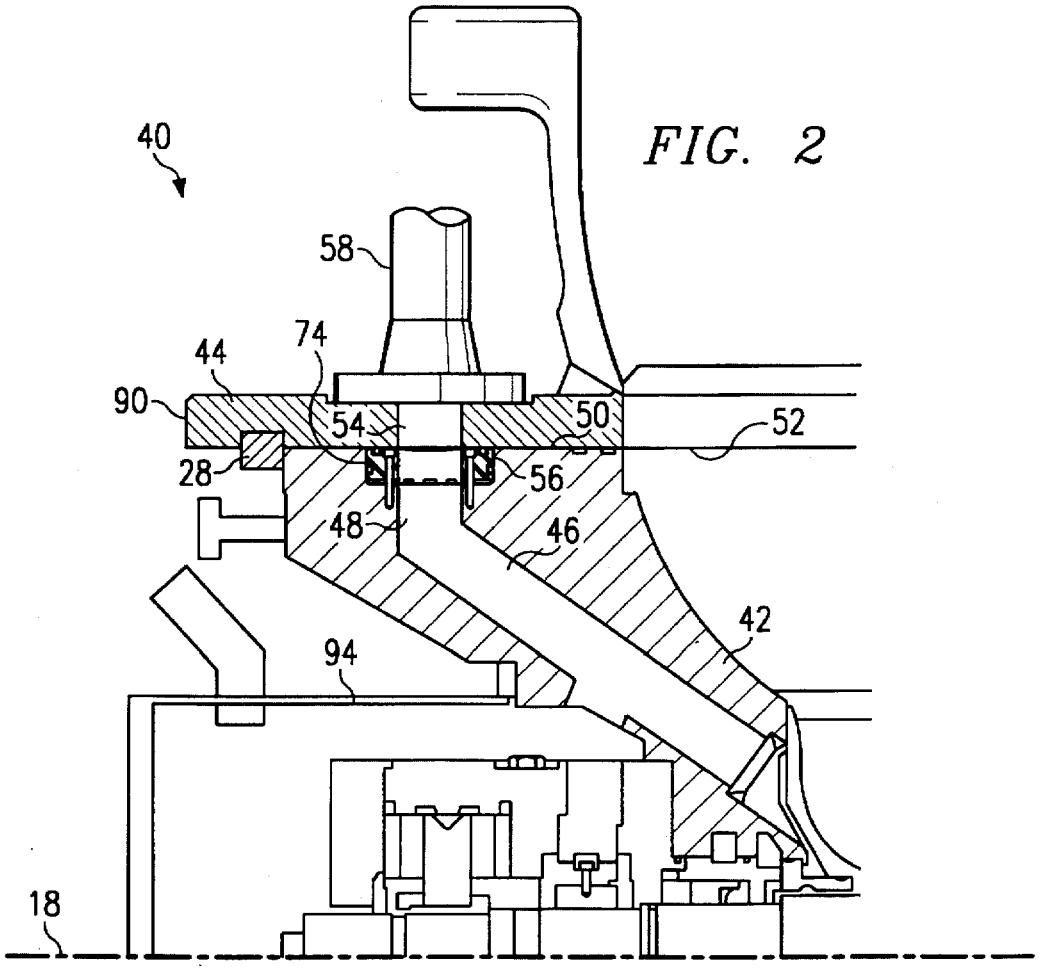
FIG. 2 is a cross-sectional view of a barrel compressor forming a first embodiment of the present invention including the head port sealing gasket.
Figure 3:
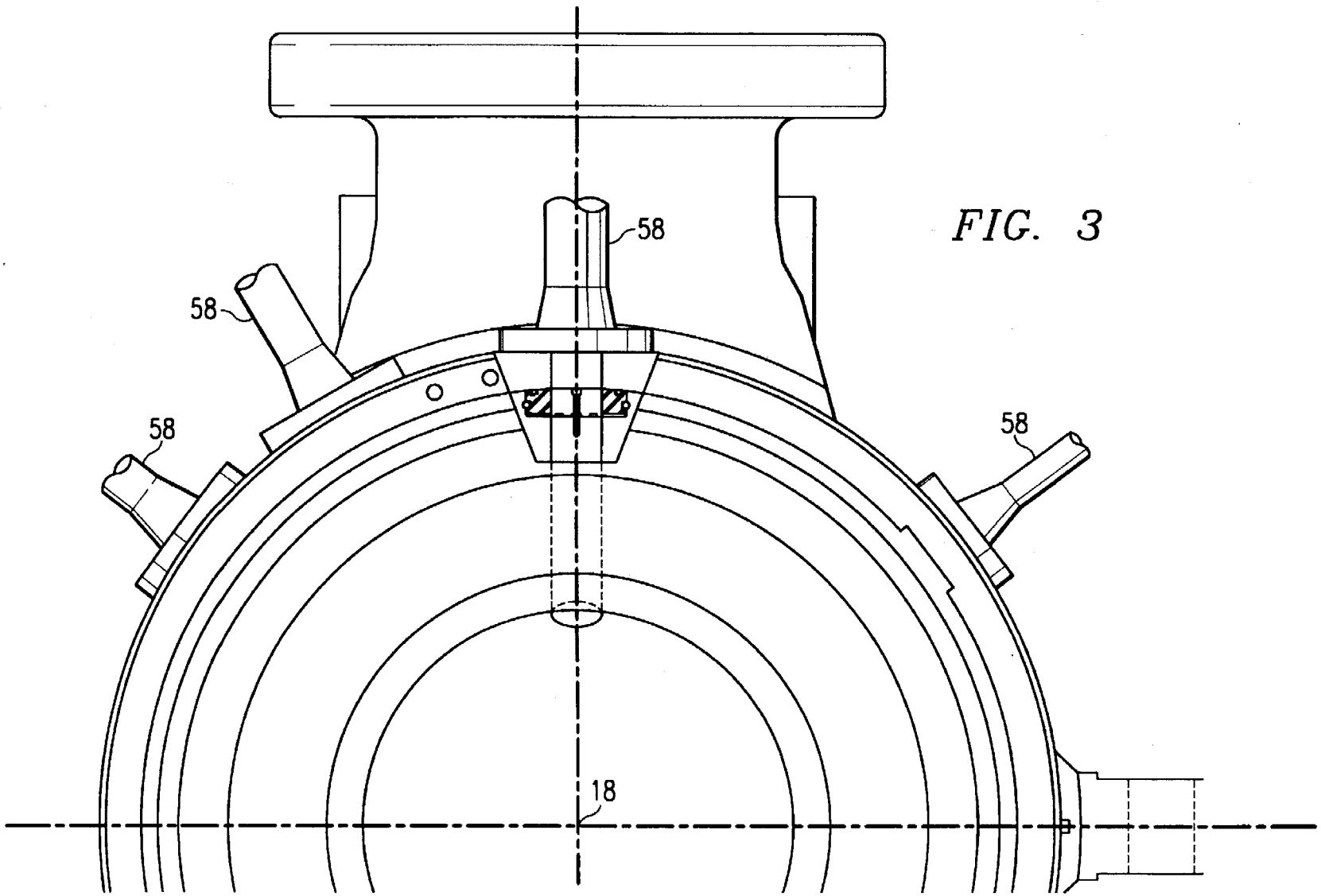
FIG. 3 is an end view of the barrel compressor of FIG. 2.
Figure 4:
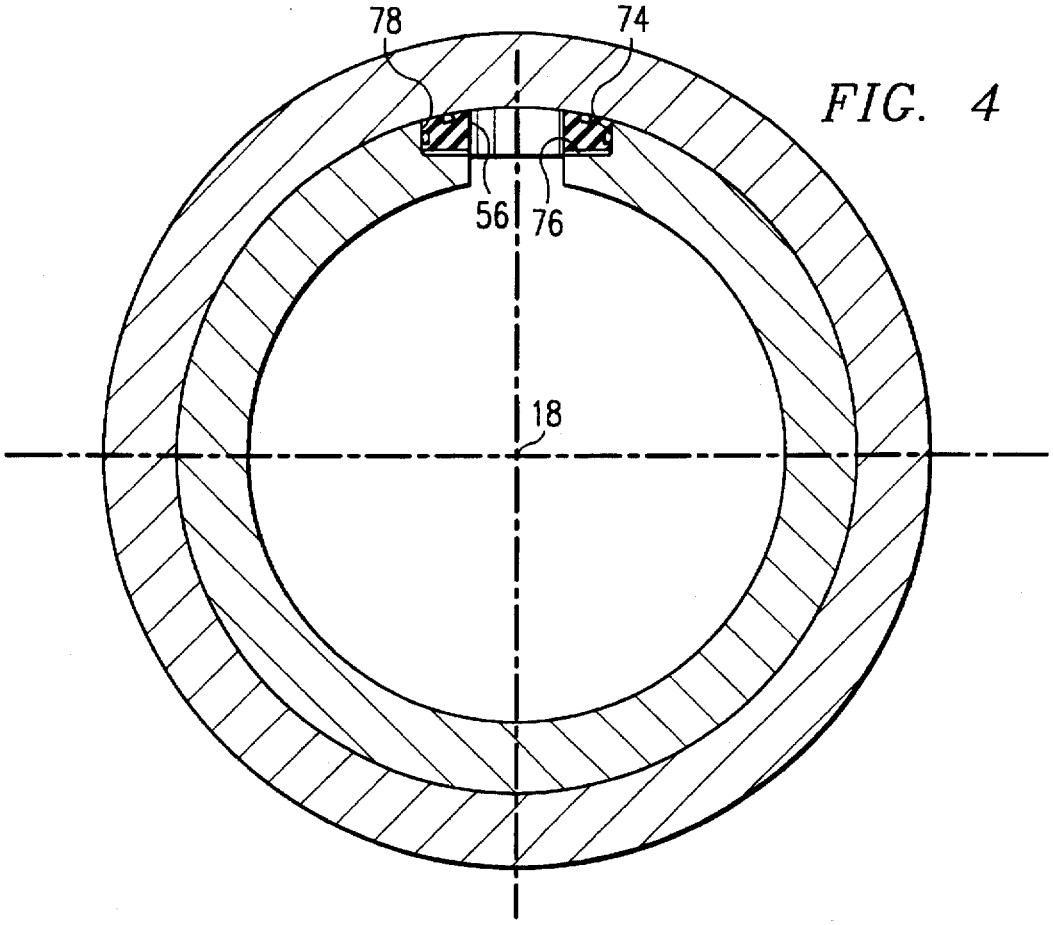
FIG. 4 is a cross-sectional view of the barrel compressor showing the installation of the head port sealing gasket.

A number of advantages are realized by the use of the gaskets 56. As seen in FIG. 2, the coupling guard 94 can be larger in diameter than that used in the compressor 10. As seen in FIG. 3, a number of lines 58 can be connected through the casing and into the head about the circumference of the casing and head, with each using one of the sealing gaskets 56. End to end pipings could run close alongside the outside of the casing over the shortest possible distance, leading to the minimal pressure drop. The quantity of drilling inside the heads is reduced, together with the amount of welding and subsequent heat treatment. No threaded ends or plugs need be installed in the head. The coupling guard can be as large as the outer diameter of the casing, thus giving a larger volume and eliminating the coupling windage problems and the need for baffles providing easy access to the bearing and to the coupling. Instrumentation can pass through the casing so there is no need for adaptors or end covers or guards to guard the wires.

It should also be understood it would be possible to mount the gaskets 56 in apertures formed in the casing if desired. In such a structure, the end of the head first contacting the gaskets should also be chamfered.

Although a single embodiment of the invention has been illustrated in the accompanying drawings, and described in the foregoing detailed description, it will be understood that the invention is not limited to the embodiment disclosed, but is capable of numerous rearrangements, modifications and substitutions of parts and elements without departing from the scope and spirit of the invention.

I claim:

1. A compressor, comprising:

a head having a cylindrical outer diameter and at least one passage formed through the head opening through the outer diameter;

a casing having a cylindrical inner diameter having a curvature and a passage formed therethrough opening through the inner diameter, the head mounted within the casing with the cylindrical outer diameter of the head facing the cylindrical inner diameter of the casing with the passages in the head and casing in alignment; and a sealing gasket having an outer surface curved to the curvature of the inner diameter of the casing sealingly engaging the inner diameter of the casing and having a second surface sealingly engaging the head, the sealing gasket having a passage therethrough connecting the passage in the head to the passage in the casing.

2. The compressor of claim 1, wherein the outer surface of the sealing gasket has an O-ring groove formed therein, the compressor further comprising an O-ring fit into the O-ring groove.

3. The compressor of claim 1, wherein the second surface of the sealing gasket has an O-ring groove formed therein, the compressor further comprising an O-ring fitted within the O-ring groove.

4. The compressor of claim 1, wherein the second surface of the sealing gasket is a cylindrical surface, an aperture bored into the outer diameter of the head to receive the sealing gasket, the aperture having a cylindrical side surface, the cylindrical surface of the sealing gasket sealingly engaging the cylindrical side surface of the head.

5. The compressor of claim 1, wherein the sealing gasket has a third surface generally parallel the outer surface, the third surface having a plurality of grooves formed therein connecting the passage through the sealing gasket to the second surface of the sealing gasket.

6. The compressor of claim 1, wherein the sealing gasket further has a plurality of holes formed therethrough receiving bolts bolting the sealing gasket to the head.

7. The compressor of claim 1, wherein the casing has an end, the end having a chamfered edge.

8. A sealing gasket for use in a compressor having a head with a cylindrical outer diameter fitting within a casing having a cylindrical inner diameter of predetermined radius, comprising:

an annular member having an outer surface, a side surface and an inner surface, the outer surface being curved with a curvature closely approximating the predetermined radius of the inner diameter of the casing, the outer surface having an O-ring groove formed therein, the annular member further having a through port, the inner surface having a plurality of notches formed therein extending from the port to the side surface thereof.

9. The sealing gasket of claim 8, wherein the side surface is a cylindrical surface having an O-ring groove formed therein.

10. The sealing gasket of claim 8, further having at least one bolt hole formed therethrough.

11. The sealing gasket of claim 8 formed of polyetheretherketone.

12. A method of assembling a head within a casing in a compressor, the head having an outer cylindrical surface of predetermined diameter, the casing having an inner cylindrical surface of predetermined diameter, comprising the steps of:

inserting a sealing gasket in a bore formed through the outer cylindrical surface of the head, the sealing gasket having an outer surface and a passage formed therethrough aligned with a passage in the head, the sealing gasket sealingly engaging the head;

inserting the head in an end of the casing, the casing having a chamfered edge, the outer surface of the sealing gasket having a curvature approximating the curvature of the inner cylindrical surface of the casing and having an O-ring groove with an O-ring therein, inserting the head causing the chamfered edge to compress the O-ring on the outer surface to permit the head to slide into the casing; and positioning the head with the passage through the head aligned with a passage through the casing, the O-ring on the outer surface sealingly engaging the sealing gasket to the inner cylindrical surface of the casing.

13. The method of claim 11, further comprising the step of bolting the sealing gasket into the bore in the head with bolts passing through passages formed through the sealing gasket.

14. A sealing gasket for use in a compressor having a head with a curved outer surface fitting within a casing having a curved inner surface of predetermined radius, comprising:

an annular member having an outer surface, a side surface and an inner surface, the outer surface being curved with a curvature closely approximating the predetermined radius of the curved inner surface of the casing the outer surface having an O-ring groove formed therein, the annular member further having a through port.

15. The sealing gasket of claim 14, wherein the side surface is a cylindrical surface having an O-ring groove formed therein.

16. The sealing gasket of claim 14, further having at least one bolt hole formed there through.

17. The sealing gasket of claim 14, formed of polyetheretherketone.

18. The sealing gasket of claim 14, wherein the inner surface has a plurality of notches formed therein extending from the port to the side surface thereof.

* * * * *